US011286808B2

(12) United States Patent
Tibbetts et al.

(10) Patent No.: US 11,286,808 B2
(45) Date of Patent: Mar. 29, 2022

(54) SYSTEM AND METHODS FOR SELECTIVE CLEANING OF TURBINE ENGINE COMPONENTS

(71) Applicant: General Electric Company, Schenectady, NY (US)

(72) Inventors: Nicole Jessica Tibbetts, Delanson, NY (US); Andrew James Jenkins, Hengoed (GB); Bernard Patrick Bewlay, Niskayuna, NY (US); Evan Jarrett Dolley, Niskayuna, NY (US); John Watt, Caerphilly Cardiff (GB); Christopher Perrett, Pontypridd (GB); Vincent Gerard Lauria, Wells, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/987,967

(22) Filed: Aug. 7, 2020

(65) Prior Publication Data

US 2020/0370443 A1 Nov. 26, 2020

Related U.S. Application Data

(62) Division of application No. 15/620,935, filed on Jun. 13, 2017, now Pat. No. 10,830,093.

(51) Int. Cl.
*F01D 25/00* (2006.01)
*F04D 29/70* (2006.01)
(Continued)

(52) U.S. Cl.
CPC ..... *F01D 25/002* (2013.01); *B08B 3/04* (2013.01); *B08B 3/08* (2013.01); *B08B 3/14* (2013.01);
(Continued)

(58) Field of Classification Search
None
See application file for complete search history.

(56) References Cited

U.S. PATENT DOCUMENTS 3,833,414 A 9/1974 Grisik et al.
4,655,383 A 4/1987 Foumes et al.
(Continued)

FOREIGN PATENT DOCUMENTS

CN 102762315 A 10/2012
CN 104894563 A 9/2015
(Continued)

OTHER PUBLICATIONS

European Search Report and Opinion Correspondin to EP18176968.8 dated Nov. 9, 2018.
(Continued)

*Primary Examiner* — Mikhail Kornakov
*Assistant Examiner* — Pradhuman Parihar
(74) *Attorney, Agent, or Firm* — Fitch, Even, Tabin & Flannery LLP

(57) ABSTRACT

System for selectively contacting a cleaning composition with a surface of a turbine engine component is presented. The system includes a cleaning apparatus and a manifold assembly. The cleaning apparatus includes an upper portion and a lower portion defining a cleaning chamber configured to allow selective contact between the cleaning composition and a surface of the first portion of the turbine engine component. The upper portion includes a plurality of fill holes in fluid communication with the cleaning chamber, and the lower portion includes a plurality of drain holes in fluid communication with the cleaning chamber. The manifold assembly is configured to selectively circulate the cleaning composition from a reservoir to the cleaning chamber via the plurality of fill holes, and recirculate the cleaning
(Continued)

composition from the cleaning chamber to the reservoir via the plurality of drain holes. Methods for selectively cleaning a turbine engine component is also presented.

16 Claims, 9 Drawing Sheets

(51) Int. Cl.

| | |
|---|---|
| ***B08B 3/08*** | (2006.01) |
| ***B08B 3/14*** | (2006.01) |
| ***B08B 3/04*** | (2006.01) |
| ***F04D 29/32*** | (2006.01) |
| ***F04D 29/08*** | (2006.01) |
| ***F04D 29/52*** | (2006.01) |
| ***F01D 5/02*** | (2006.01) |
| ***F01D 5/12*** | (2006.01) |
| ***F01D 11/00*** | (2006.01) |
| ***F01D 25/24*** | (2006.01) |

(52) U.S. Cl.
CPC ..... *F01D 25/007* (2013.01); *F04D 29/701* (2013.01); *F01D 5/02* (2013.01); *F01D 5/12* (2013.01); *F01D 11/003* (2013.01); *F01D 25/24* (2013.01); *F04D 29/083* (2013.01); *F04D 29/324* (2013.01); *F04D 29/522* (2013.01); *F05D 2220/32* (2013.01)

(56) References Cited

U.S. PATENT DOCUMENTS

| | | | | |
|---|---|---|---|---|
| 5,618,353 | A | 4/1997 | Irvine et al. | |
| 5,653,817 | A | 8/1997 | Schuenke et al. | |
| 5,685,917 | A | 11/1997 | Sangeeta | |
| 6,310,022 | B1 | 10/2001 | Amiran | |
| 6,440,856 | B1 | 8/2002 | Bessho et al. | |
| 7,115,171 | B2 | 10/2006 | Powers et al. | |
| 7,531,048 | B2 | 5/2009 | Woodcock et al. | |
| 7,687,449 | B2 | 3/2010 | Powers et al. | |
| 8,240,042 | B2 | 8/2012 | Williams et al. | |
| 2003/0050204 | A1 | 3/2003 | Lagraff et al. | |
| 2004/0062864 | A1 | 4/2004 | Langley et al. | |
| 2004/0074883 | A1 | 4/2004 | Kilburn | |
| 2009/0038652 | A1 | 2/2009 | Kang | |
| 2011/0083701 | A1 * | 4/2011 | Esmacher | B08B 9/00 134/22.11 |
| 2011/0120972 | A1 | 5/2011 | Faulkner et al. | |
| 2015/0197712 | A1 | 7/2015 | Ekanayake et al. | |
| 2016/0024444 | A1 | 1/2016 | Stratton et al. | |
| 2018/0094217 | A1 | 4/2018 | Dolley et al. | |

FOREIGN PATENT DOCUMENTS

| | | | | |
|---|---|---|---|---|
| CN | 103602996 | B | 3/2016 | |
| DE | 29805627 | U1 | 9/1999 | |
| DE | 102015203323 | A1 | 8/2016 | |
| EP | 2286933 | A1 | 2/2011 | |
| EP | 2407254 | A1 * | 1/2012 | F01D 25/002 |
| EP | 2407254 | A1 | 1/2012 | |
| JP | H04276088 | A | 10/1992 | |

OTHER PUBLICATIONS

Nezhad-nobijari et al., Evaluation of the Aluminide Coating on Cleaned Internal Passages of Used Gas Turbine Blades, Surface and Coatings Technology, vol. 289, Mar. 15, 2016, pp. 206-212.

Combined Chinese Office Action and Search Report Corresponding to Application No. 201810607422 dated Jul. 28. 2020.

* cited by examiner

SYSTEM AND METHODS FOR SELECTIVE CLEANING OF TURBINE ENGINE COMPONENTS

CROSS REFERENCE TO RELATED APPLICATION

This application claims priority to, and is a divisional application of, U.S. patent application Ser. No. 15/620,935 filed Jun. 13, 2017 which is incorporated by reference in its entirety herein.

BACKGROUND

Embodiments of the disclosure generally relate to system and methods for selectively cleaning turbine engine components. More particularly, embodiments of the disclosure relate to system and methods for selectively cleaning turbine engine components using viscous cleaning compositions.

As the maximum operating temperatures of the gas turbine engines increase, the components of the gas turbine engines (e.g., turbine disks, shafts or seal elements) are subjected to higher temperatures. Thus, oxidation and corrosion of these components have become of greater concern. Turbine engine components for use at such high operating temperatures are typically made of nickel and/or cobalt-based superalloys, selected for good elevated temperature toughness and fatigue resistance. These superalloys have resistance to oxidation and corrosion damage, but that resistance is not sufficient to completely protect them at the operating temperatures now being reached. Over time, engine deposits, such as (but not limited to) nickel oxides and/or aluminum oxides, can form a coating or layer on the surface of these turbine components. These engine deposits typically need to be cleaned off or otherwise removed. Other components, especially those that operate at comparatively lower temperatures, may be made of other alloy types, such as titanium or steel; these components may also become oxidized during service.

Further, certain components of the turbine engines may require inspection during their service life for defects (for example, crack formation). However, the effectiveness of typical techniques employed for inspection (for example, crack detection) may be compromised by the presence of oxides on the metal surfaces of these components. Typical cleaning methods employed for removing these oxides before inspection may require one or more of abrasive cleaning techniques (e.g., abrasive wet blast), multiple cleaning cycles, large volumes of the cleaning fluid, or manual application of the cleaning fluid to the component being cleaned. Therefore, the conventional cleaning techniques may pose various challenges such as being cost-ineffective, cumbersome to employ, and additional environmental and health safety concerns.

Furthermore, cleaning operations for gas turbine engines often employ chemical means, such as acid solutions, to remove oxides and other engine deposits from components. Although, such techniques can be effective, they can be challenging to apply effectively in situations where it is desirable to limit the area over which the cleaning composition used to remove the deposits is in contact with the component. For instance, some components include multiple materials, where one or more of the materials is incompatible with the cleaning composition. As another example, in some components there is a propensity to develop deposits only in specific locations, while other locations on the component remain acceptably free of deposits. In instances, such as these, where only selective exposure of the component area to the cleaning composition is desirable, typical processes require additional steps, such as component disassembly, masking procedures, or having to reapply dimensional build up materials and other techniques that add time and expense to the overall cleaning process.

Accordingly, it would be desirable to be able to effectively and efficiently clean and remove engine deposits, especially engine deposits comprising metal oxides, from turbine engine components. It would be especially desirable to be able to selectively clean and remove such engine deposits in a manner that does not excessively or substantially remove or alter the base metal of the component. It would further be desirable to have cleaning systems and methods that allow for effective and efficient cleaning of such engine deposits in a selective manner.

BRIEF DESCRIPTION

In one aspect, the disclosure relates to a system for selectively contacting a cleaning composition with a surface of a turbine engine component. The system includes a cleaning apparatus and a manifold assembly. The cleaning apparatus includes an upper portion and a lower portion together defining a cleaning chamber. The cleaning chamber is configured to receive a first portion of the turbine engine component and allow selective contact between the cleaning composition and a surface of the first portion of the turbine engine component. The upper portion includes a plurality of fill holes in fluid communication with the cleaning chamber, and the lower portion includes a plurality of drain holes in fluid communication with the cleaning chamber. The manifold assembly is in fluid communication with the plurality of fill holes and the plurality of drain holes. The manifold assembly is configured to selectively circulate the cleaning composition from a reservoir to the cleaning chamber via the plurality of fill holes, and recirculate the cleaning composition from the cleaning chamber to the reservoir via the plurality of drain holes.

In another aspect, the disclosure relates to a method for selectively contacting a cleaning composition with a surface of a turbine engine component. The method includes disposing a first portion of the turbine engine component in a cleaning chamber of a cleaning apparatus, the cleaning chamber defined by an upper portion and a lower portion of the cleaning apparatus. The method further includes circulating the cleaning composition from a reservoir to the cleaning chamber via a manifold assembly and a plurality of fill holes disposed in the upper portion of the cleaning apparatus. The method further includes selectively contacting the cleaning composition with a surface of the first portion of the turbine engine component. The method furthermore includes recirculating the cleaning composition from the cleaning chamber to the reservoir via the manifold assembly and a plurality of drain holes disposed in the lower portion of the cleaning apparatus.

In yet another aspect, the disclosure relates to a method for selectively cleaning a surface of a turbine engine component. The method includes: (I) applying a cleaning cycle to the surface of the turbine engine component, the cleaning cycle comprising sequentially contacting the surface of the turbine engine component with an alkaline composition, a first acid composition; a first alkali metal permanganate composition; and a second acid composition. The method further includes: (II) selectively contacting a first portion of the surface of the turbine engine component with a second alkali metal permanganate composition. The method furthermore includes: (III) selectively contacting the first portion of the surface of the turbine engine component with a cleaning composition having a viscosity of at least $10^4$ poise, the cleaning composition comprising a third acid composition, an active compound, and a thickening agent. The steps (II) and (III) are effected such the remaining second portion of the surface of the turbine engine component is substantially free of contact with the second alkali metal permanganate composition and the cleaning composition.

These and other features, embodiments, and advantages of the present disclosure may be understood more readily by reference to the following detailed description.

DRAWINGS

These and other features, aspects, and advantages of the present disclosure will become better understood when the following detailed description is read with reference to the accompanying drawings, wherein.

DETAILED DESCRIPTION

Figure 1A:
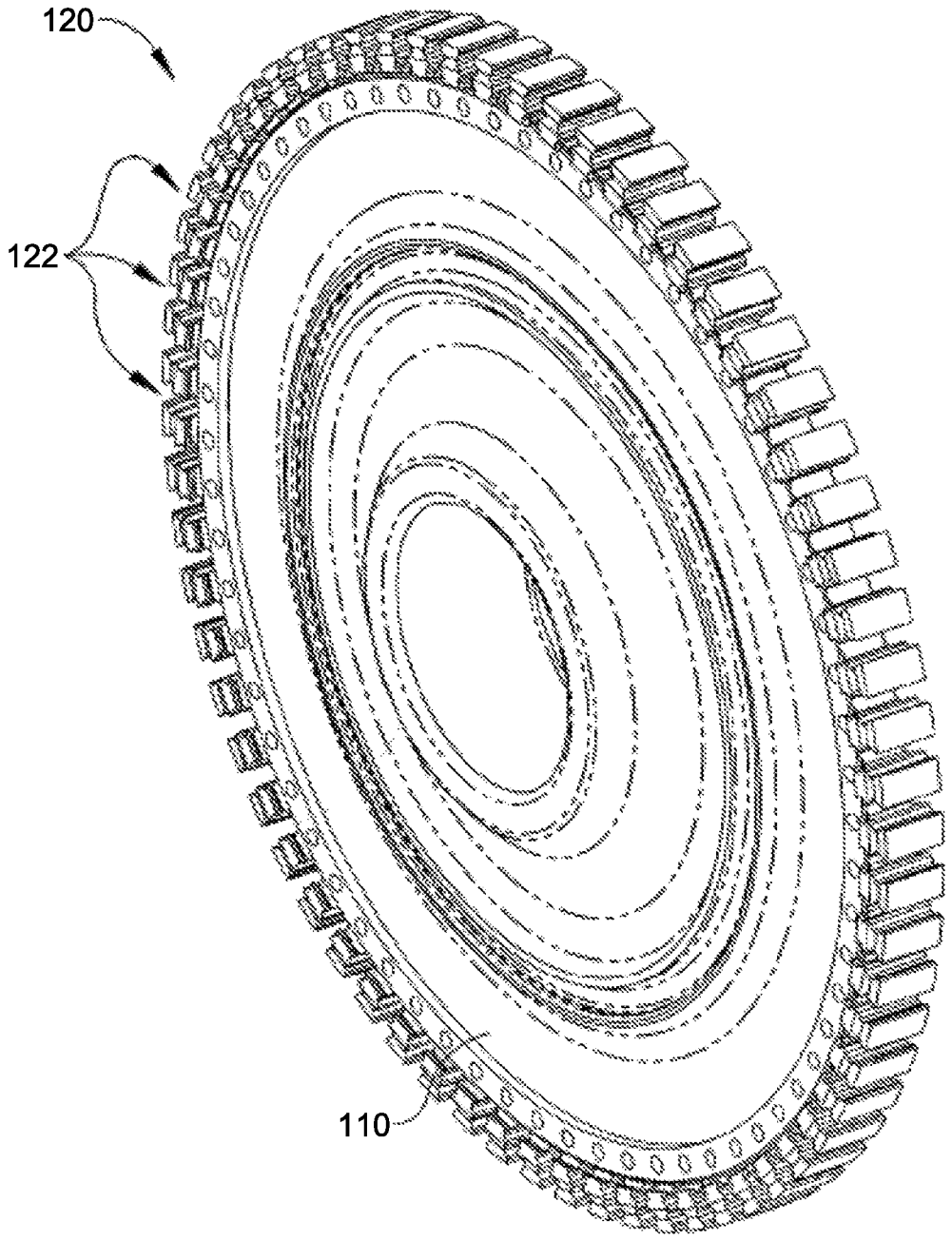
FIG. 1A illustrates an example of a turbine engine component, in accordance with some embodiments of the disclosure.

In the following specification and the claims, which follow, reference will be made to a number of terms, which shall be defined to have the following meanings. The singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about", and "substantially" is not to be limited to the precise value specified. In some instances, the approximating language may correspond to the precision of an instrument for measuring the value. Similarly, "free" may be used in combination with a term, and may include an insubstantial number, or trace amounts, while still being considered free of the modified term. Here and throughout the specification and claims, range limitations may be combined and/or interchanged, such ranges are identified and include all the sub-ranges contained therein unless context or language indicates otherwise.

The systems and methods described herein address the noted shortcomings in conventional cleaning methods and systems, at least in part, through the use of a cleaning composition of high viscosity relative to conventional liquid cleaning compositions. The viscous composition substantially remains in the region of the part on which it is disposed during the cleaning procedure, thereby providing the ability to clean selected areas of a turbine engine component without unduly exposing adjacent areas where exposure to a cleaning composition is undesirable or incompatible with component materials. Further, by employing the systems and methods described herein, selective cleaning of the turbine engine components may be achieved while enabling one or more of (i) limiting contact of the cleaning composition to the areas that need cleaning, (ii) efficient and effective cleaning of multiple portions of the turbine engine component, (iii) minimizing contact times of the cleaning composition, thereby minimizing corrosion, (iv) reuse of the cleaning composition, thereby reducing the volumes required, (iv) minimizing human contact with the cleaning compositions and effluent streams, and (vi) collection of the effluent stream in a substantially non-hazardous manner.

A system for selectively contacting a cleaning composition with a surface of a turbine engine component is presented. A turbine engine refers to any engine in which the turbine is driven by the combustion products of air and fuel. In some embodiments, the turbine engine may be an aircraft engine. Alternatively, the turbine engine may be any other type of engine used in industrial applications. Non-limiting examples of such turbine engines include a land-based turbine engine employed in a power plant, a turbine engine used in a marine vessel, or a turbine engine used in an oil rig. The terms "gas turbine engine" and "turbine engine" are used herein interchangeably.

As used herein, the term "turbine engine component" refers to a wide variety of turbine engine (e.g., gas turbine engine) parts and components, which can have engine deposits formed on the surface thereof during normal engine operation that can require removal. The methods and systems described herein are particularly useful when applied to an engine component that oxidizes during service, though it will be appreciated that this is not a necessary limitation to the scope of methods and systems.

Non-limiting examples of turbine engine components that may be cleaned by the methods and systems disclosed herein include, but are not limited to, turbine disks, turbine blades, compressor disks, compressor blades, compressor spools, rotating seals, frames, or cases.

In some embodiments, the turbine engine component is or includes a turbine disk for a turbine engine assembly. Such disks are well known to have a generally annular shaped hub portion and an outermost rim portion (referred to herein as "dovetail region") shaped into a plurality of dovetails for engaging a respective plurality of turbine blades. In certain embodiments, as describe in detail later, the method and systems as described here are particularly useful in removing engine deposits from the surfaces of a plurality of dovetail portions of the turbine disks. The term "dovetail portion" as used herein refers to some or all of the dovetail region. FIG. 1A illustrates an example turbine disk 100 include a hub portion 110 and an outermost rim portion 120. As illustrated in FIG. 1A, the outermost rim portion 120 includes a plurality of dovetail regions 122. In some embodiments, the portion of the turbine engine component that is selectively contacted with the cleaning composition, in accordance with the methods and systems described herein, includes at least a portion of the plurality of dovetail regions 122.

Similarly, turbine blades (not shown in figures) typically include a dovetail portion in the region of the blade that engages the disk. This dovetail portion (again, some or all of the dovetail portion) of the blade may be selectively contacted with the cleaning composition using the methods and systems described herein, in some embodiments. In yet another example, the turbine engine component is or includes the case or frame (not shown in figures) for a compressor or turbine. For example, low-pressure turbine cases have a design feature called a rail, where mating parts rest, that oxidizes because it extends into the hot gas path and is difficult to clean. The rail portion of these cases may be selectively contacted with the cleaning composition, using the methods and systems described herein, in some embodiments.

The turbine engine component includes a metal. In some embodiments, the turbine engine component includes a superalloy, a steel such as stainless steel, a titanium alloy, or other metals commonly used in engine components. In certain embodiments, the turbine engine component includes a superalloy, for example, a nickel-based superalloy, iron-based superalloy, cobalt-based superalloy, or combinations thereof. Illustrative nickel or cobalt-based superalloys are designated by the trade names INCONEL (e.g., INCONEL 718), NIMONIC, RENE (e.g., RENE 88, RENE 104 alloys), HAYNES, and UDIMET. For example, an alloy that can be used in making turbine disks, turbine shafts, and other useful components is a nickel-based superalloy available under the trade name INCONEL 718 that has a nominal composition, by weight, of 52.5% nickel, 19% chromium, 3% molybdenum, 3.5% manganese, 0.5% aluminum, 0.45% titanium, 5.1% combined tantalum and niobium, and 0.1% or less carbon, with the balance being iron. As another example, a nickel-based superalloy available under the trade name RENE 88DT has a nominal composition, by weight, of 13% cobalt, 16% chromium, 4% molybdenum, 4% tungsten, 2.1% aluminum, 3.7% titanium, 0.7% niobium, 0.03% carbon, and 0.015% boron.

The term "engine deposit" as used herein refers to those deposits that form over time during the operation of a gas turbine engine as a coating, layer, crust, etc., on the surface of turbine component. These engine deposits typically comprise oxides of the base metal. In some embodiments, the oxide includes material formed by oxidation of the metal in the engine component during service or manufacturing, meaning the oxide includes at least one element derived from the metal of the turbine engine component. As an example, where the turbine engine component includes a nickel alloy, the oxide at the surface of the turbine engine component may include nickel, such as a nickel oxide or a spinel that includes nickel and other elements such as chromium, aluminum, or a combination thereof. The highly alloyed superalloys, such as RENE 88DT, RENE 104, and others, for example, have been found to have increasingly complex oxides with increasing alloying content, for example mixtures of cobalt oxides and spinels and titanium oxides in addition to the more typically seen nickel or chromium or aluminum oxide. The nature of the oxide will depend in part on the composition of the metal at the surface of the turbine engine component and the environmental conditions (e.g., temperature, atmosphere) under which the oxide is formed.

The system includes a cleaning apparatus and a manifold assembly. The cleaning apparatus includes an upper portion and a lower portion together defining a cleaning chamber. The cleaning chamber is configured to receive a first portion of the turbine engine component and allow contact between the cleaning composition and a surface of the first portion of the turbine engine component. The upper portion includes a plurality of fill holes in fluid communication with the cleaning chamber, and the lower portion includes a plurality of drain holes in fluid communication with the cleaning chamber. The manifold assembly is in fluid communication with the plurality of fill holes and the plurality of drain holes. The manifold assembly is configured to selectively circulate the cleaning composition from a reservoir to the cleaning chamber via the plurality of fill holes, and recirculate the cleaning composition from the cleaning chamber to the reservoir via the plurality of drain holes.

Figure 2:
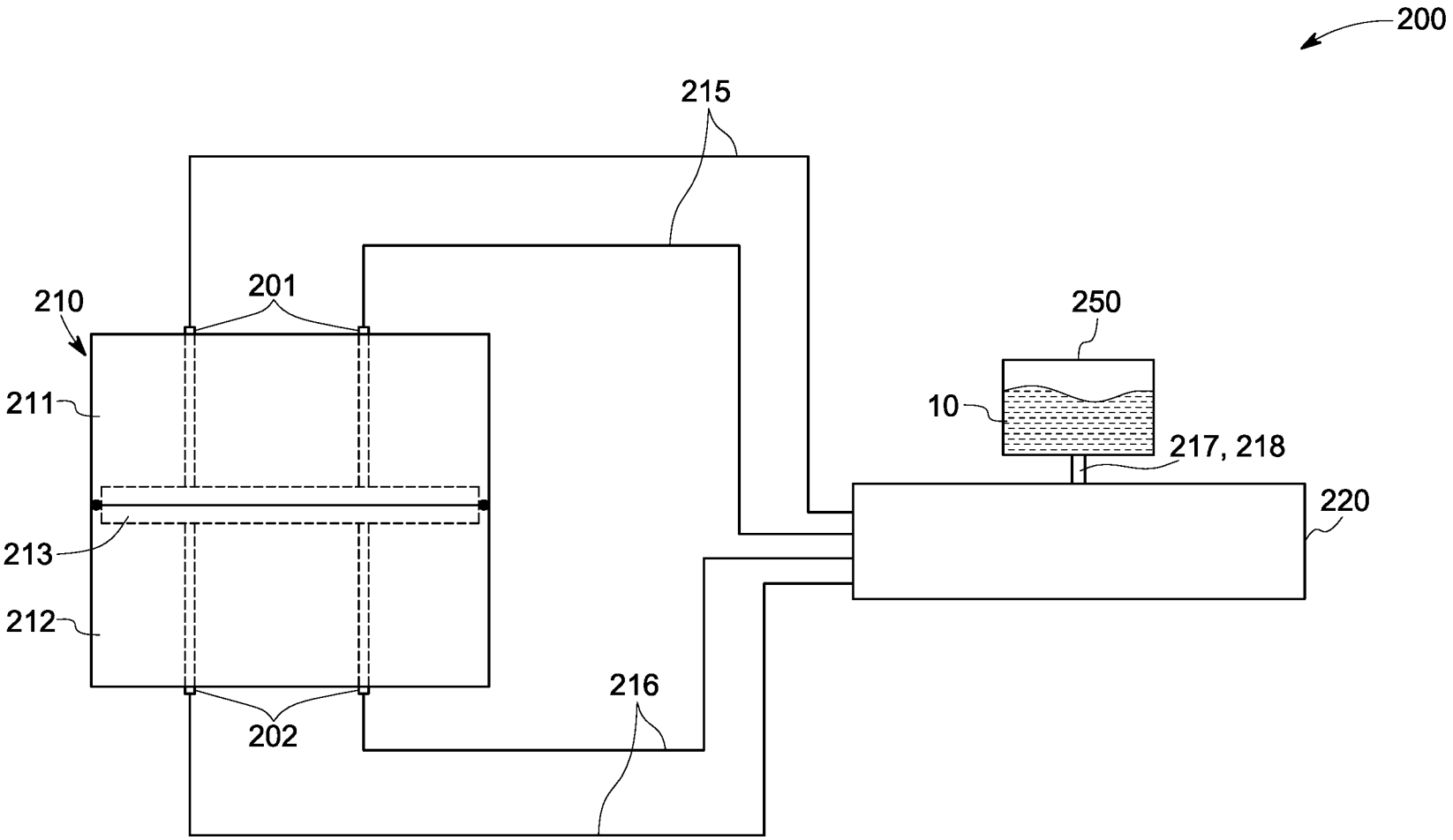
FIG. 2 illustrates a line drawing of a system for selectively contacting a cleaning composition with a surface of a turbine engine component, in accordance with some embodiments of the disclosure.
Figure 3:
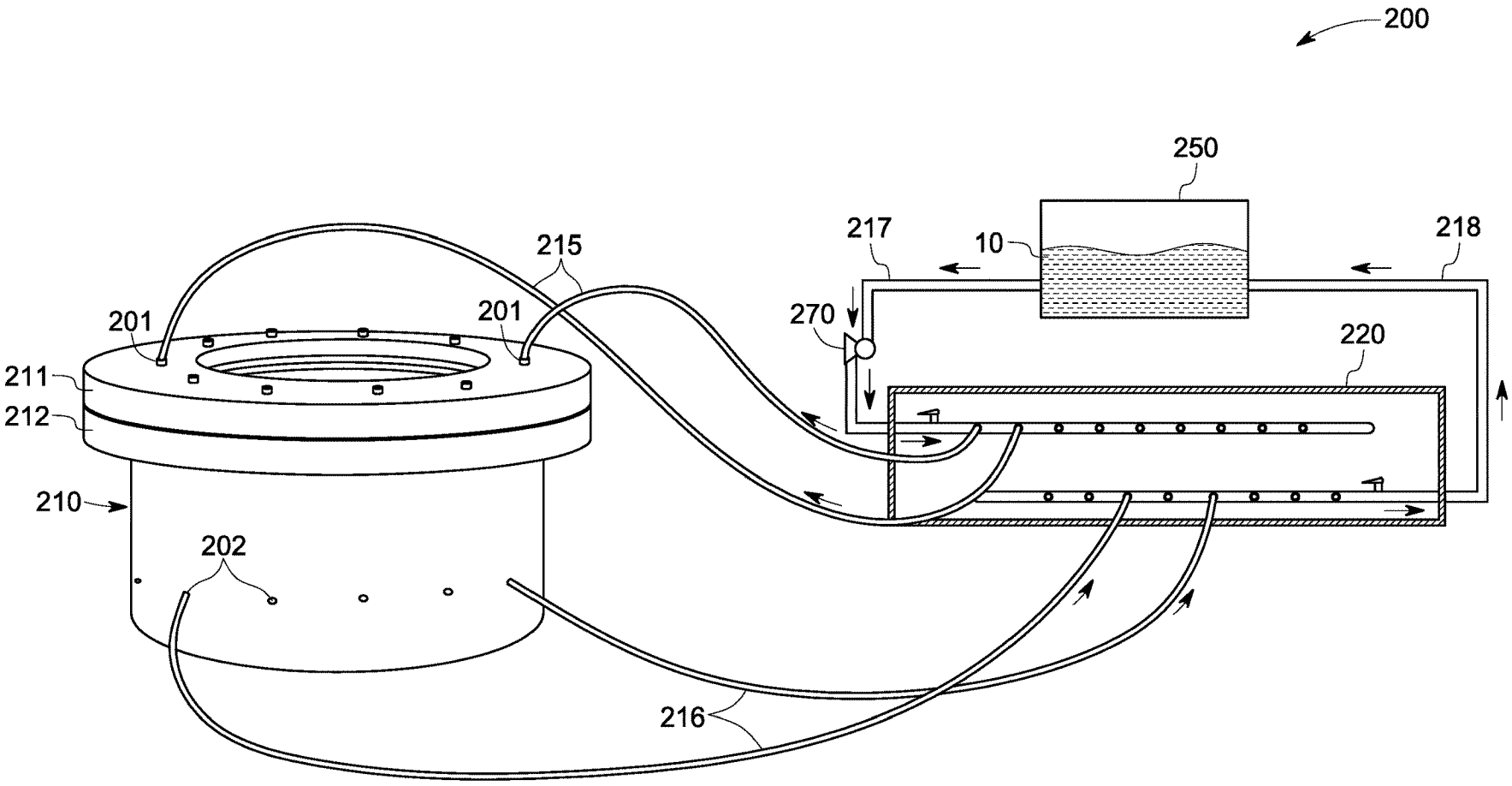
FIG. 3 illustrates a schematic of a system for selectively contacting a cleaning composition with a surface of a turbine engine component, in accordance with some embodiments of the disclosure.

FIGS. 2 and 3 illustrate a system 200 for selectively contacting a cleaning composition 10 with a surface of a turbine engine component, in accordance with some embodiments of the disclosure. FIG. 2 illustrates a line drawing of the system 200 and FIG. 3 illustrates a schematic of an example system 200, in accordance with some embodiments of the disclosure. The system 200 includes a cleaning apparatus 210 and a manifold assembly 220. The cleaning apparatus 210 includes an upper portion 211 and a lower portion 212. As illustrated in FIG. 2, the upper portion 211 and the lower portion 212 together define a cleaning chamber 213. The cleaning chamber is configured to receive a first portion of the turbine engine component (not shown in FIG. 2) and allow contact between the cleaning composition and a surface of the first portion of the turbine engine component. It should be noted that the terms "upper portion" and "lower portion" are used herein for ease of description only and do not connotate any specific orientation of the two portions. In some embodiments, the terms "upper portion" and "lower portion" may be described in the context of the surface of the turbine engine component that requires cleaning. For example, in some such instances, the "upper portion" may refer to the portion of the cleaning apparatus that will be proximate to the surface being cleaned. In some embodiments, the upper portion and the lower portion are removable coupled to each other.

Further, as illustrated in FIGS. 2 and 3, the upper portion 211 includes a plurality of fill holes 201 in fluid communication with the cleaning chamber 213, and the lower portion 212 includes a plurality of drain holes 202 in fluid communication with the cleaning chamber 213. It should be noted that the number, shape, size, and location of the fill holes 201 and the drain holes 202 in FIGS. 2 and 3 are for illustration purposes only. One or more of the above design characteristics of the fill holes 201 and the drain holes 202 may be varied based, at least in part, on one or more of the shape and size of the surface being cleaned, the contact time desired, the cleaning composition 10 characteristics (for example, viscosity, volume, temperature, and the like), and the pressure applied for circulating the cleaning composition 10. In some embodiments, the number of fill holes 201 in the upper portion 211 may be in a range from about 4 to about 12. In some embodiments, the number of drain holes 202 in the lower portion 212 may be in a range from about 4 to about 12. Further, the fill holes 201 and the drain holes 202 may be directly aligned with each other, or, alternatively, may be staggered with respect to each other.

The manifold assembly 220 is in fluid communication with the plurality of fill holes 201 and the plurality of drain holes 202. The term "in fluid communication" as used herein means that the two components or parts of the system (for example, a manifold assembly and the fill holes) are able to transfer a fluid from one to the other either directly, or, by use of intervening components (for example, pipes, conduits, valves, and the like).

Furthermore, as illustrated in FIGS. 2 and 3, the manifold assembly 220 is configured to selectively circulate the cleaning composition 10 from a reservoir 250 to the cleaning chamber 213 via the plurality of fill holes 201, and recirculate the cleaning composition 10 from the cleaning chamber 213 to the reservoir 250 via the plurality of drain holes 202. The manifold assembly 220 may be fluidly coupled to the fill holes 201 and the drain holes 202 via one or more of pipes, conduits, and the like. In certain embodiments, the manifold assembly 220 is in fluid communication with the plurality of fill holes 201 and the plurality of drain holes 202, via a plurality of pipes 215 and 216, respectively. FIGS. 2 and 3 illustrate only two pipes 215 and 216, for ease of representation. However, the system 200 may include a plurality of pipes 215 for circulating the cleaning composition 10 from the reservoir 250 to the fill holes 201, and similarly may include a plurality of pipes 216 for recirculating the cleaning composition 10 from the drain holes 202 to the reservoir 250. In some embodiments, the system includes the same number of pipes 215 for circulating the cleaning composition 10 as the number of fill holes 201. In some embodiments, the system includes a fewer number of pipes 215 for circulating the cleaning composition 10, as compared to the number of fill holes 201. In some embodiments, the system includes the same number of pipes 216 for recirculating the cleaning composition 10 as the number of drain holes 202. In some embodiments, the system includes a fewer number of pipes 216 for recirculating the cleaning composition 10, when compared to the number of drain holes 202.

The manifold assembly 220 may be in fluid communication with the reservoir 250 via appropriate mechanism, for example, pipes, conduits, and the like. In the embodiments illustrated in FIGS. 2 and 3, the manifold assembly is fluidly coupled to the reservoir 250 via conduits 217 and 218. The inflow and outflow of the cleaning composition 10, to and from the manifold assembly 220, may be further controlled by using appropriate fluid control mechanisms, for example, valves.

In some embodiments, the cleaning chamber 213 may be characterized by a geometry and volume such that the first portion of the turbine engine component can be easily accommodated in the cleaning chamber 213. Therefore, the configuration of the cleaning chamber 213 may be designed and fabricated, depending on the geometry and configuration of the turbine engine component to be cleaned. As will be apparent to one of ordinary skill in the art, the geometry and configuration of the cleaning chamber 213 can be varied by changing the geometry and configuration of the upper portion 211 and the lower portion 212 of the cleaning apparatus 210.

In some embodiments, the cleaning chamber 213 may be configured to receive at least a portion of different types of gas turbine engine components, non-limiting examples of which include, a turbine disk, a turbine blade, a compressor disk, a compressor blade, a compressor spool, a rotating seal, a frame, or a case. In some embodiments, the cleaning chamber 213 may be configured to receive a dovetail region of a turbine disk. In certain embodiments, the cleaning chamber 213 may be configured to receive a plurality of such dovetail regions of a turbine disk.

As mentioned previously, the system and methods described herein allow for selective cleaning of a surface of the turbine engine component, without necessitating the use of component disassembly or cumbersome masking techniques. In some embodiments, the system 200, as described herein, may allow for selectively application of the cleaning composition 10 to the surface of the turbine engine component by allowing for only a certain portion of the turbine engine component to be contacted by the cleaning composition 10. Thus, effectively masking the remaining portion of the turbine engine component, without necessitating the use of additional masking systems.

Figure 1B:
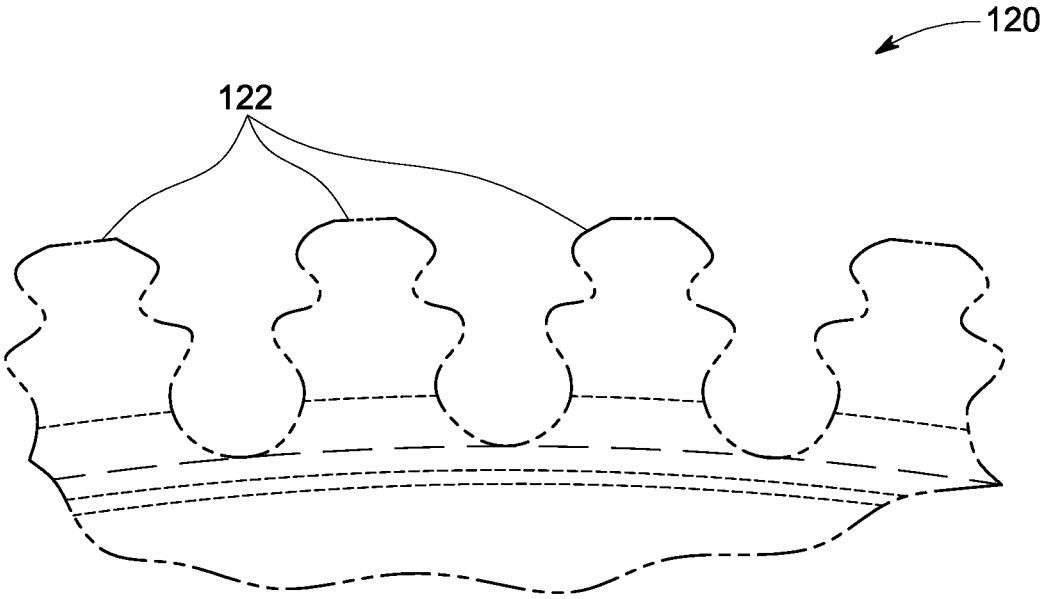
FIG. 1B illustrates an expanded view of a portion of a turbine engine component, in accordance with some embodiments of the disclosure
Figure 4A:
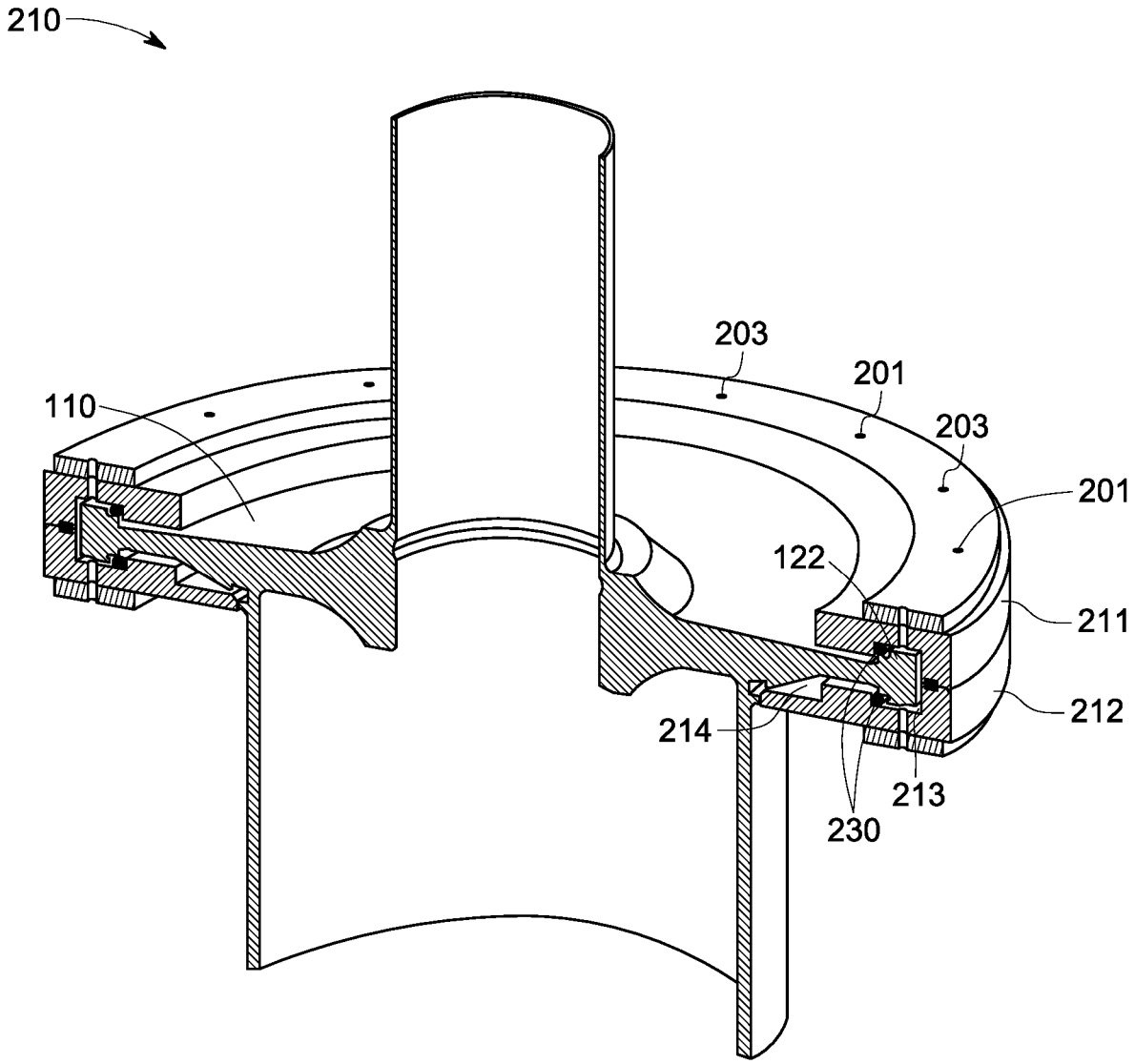
FIG. 4A illustrates a cross-sectional view of a system for selectively contacting a cleaning composition with a surface of a turbine engine component, in accordance with some embodiments of the disclosure.
Figure 4B:
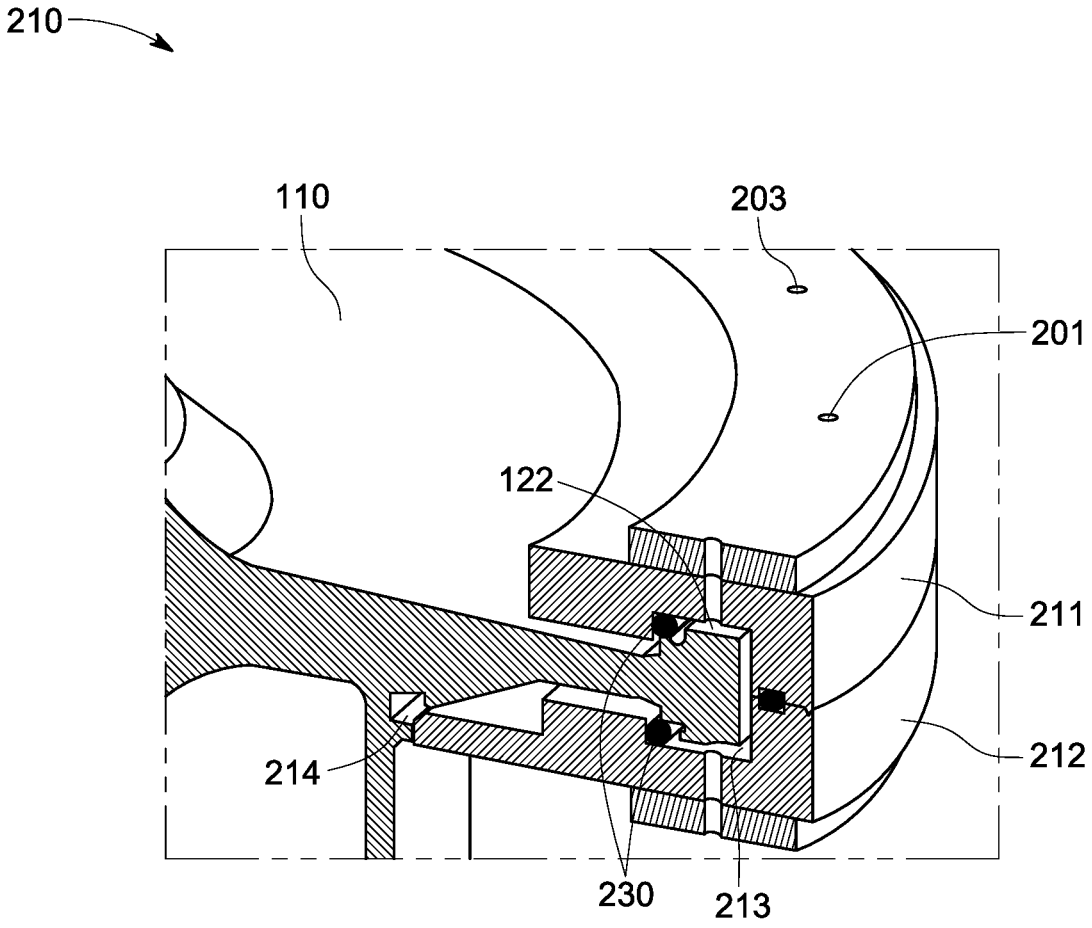
FIG. 4B illustrates an expanded section of a cross-sectional view of a system for selectively contacting a cleaning composition with a surface of a turbine engine component, in accordance with some embodiments of the disclosure.

Referring now to FIGS. 4A and 4B, a schematic of a cross-sectional view of the cleaning apparatus 210 and an expanded view of a portion of the cleaning apparatus 210, are illustrated respectively. The cleaning apparatus 210 includes an upper portion 211 and a lower portion 212 defining a cleaning chamber 213. The upper portion further includes a plurality of fill holes 201. In the embodiments, illustrated in FIGS. 4A and 4B, a first portion of the turbine engine component is disposed in the cleaning chamber 213. In an example embodiment, the turbine engine component is a turbine disk 100 (shown in FIG. 1), and the first portion of the turbine engine component is a dovetail region 122 of the turbine disk 100. It should be noted that for illustration purposes, only one dovetail region 122 is shown in FIGS. 4 and 4B, however, a plurality of such dovetail regions 122 may be disposed in the cleaning chamber, for example, arranged circumferentially.

Referring again to FIGS. 4A and 4B, the upper portion 211 and the lower portion 212 of the cleaning apparatus 210 further define a masking chamber 214. The masking camber is configured to receiving a second portion of the turbine engine component. In the example illustrated in FIGS. 4A and 4B, the second portion is a hub portion 110 of the turbine disk 100 (shown in FIG. 1). The masking chamber 214 and the cleaning chamber 213 are fluidly sealed from each other via a sealing mechanism 230 such that a surface of the second portion of the turbine engine component is not substantially contacted with the cleaning composition 10. That is, for example, the hub portion 110 of the turbine disk 100 is not substantially contacted with the cleaning composition 10. Therefore, by employing a cleaning apparatus configuration in accordance with embodiments of the disclosure, selective contacting and cleaning of a turbine engine component may be effected in an efficient and effective manner. In some embodiments, the cleaning apparatus 210 has a clam shell architecture. Any suitable sealing mechanism may be used as long as the sealing mechanism is capable of fluidly sealing the masking chamber 214 and the cleaning chamber 213. In some embodiments, gaskets may be employed as a sealing mechanism 230.

Figure 5:
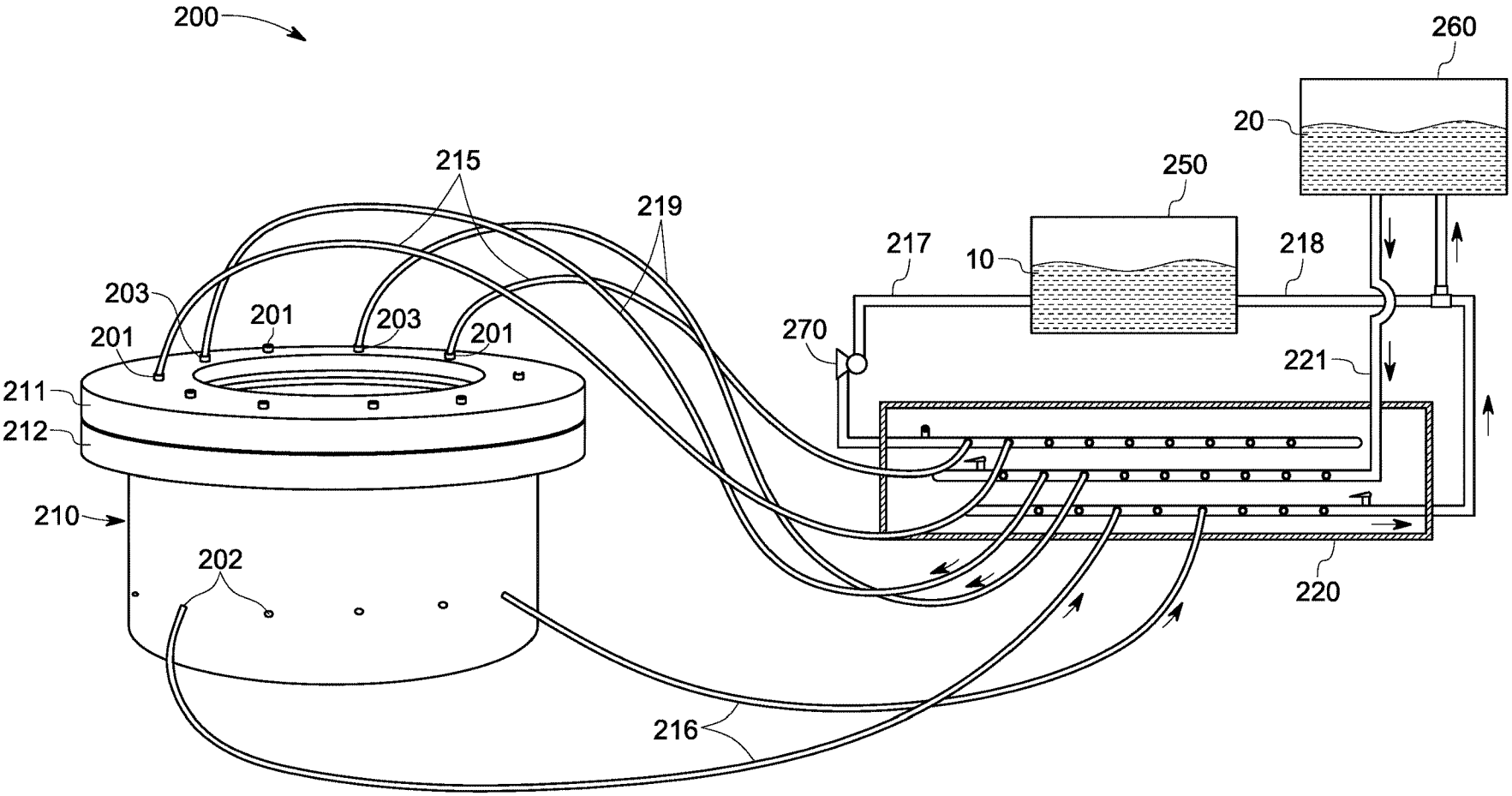
FIG. 5 illustrates a schematic of a system for selectively contacting a cleaning composition with a surface of a turbine engine component, in accordance with some embodiments of the disclosure.
Figure 6:
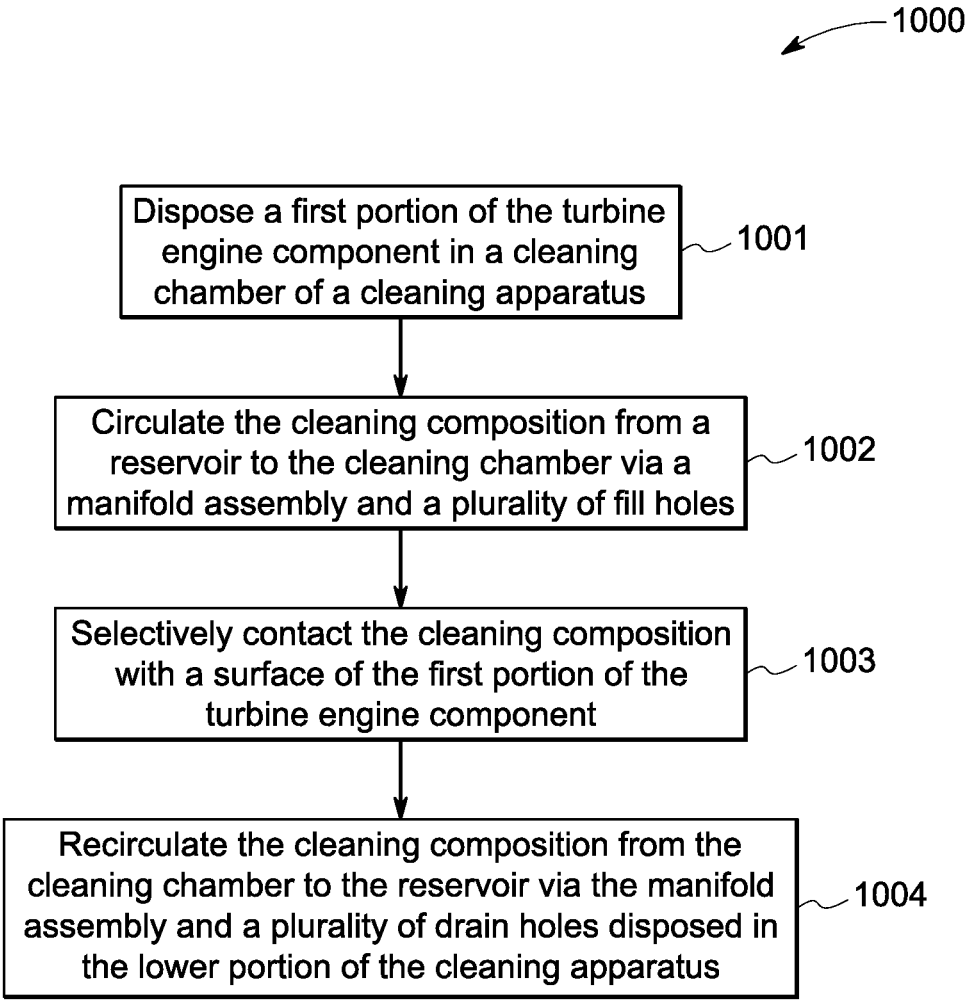
FIG. 6 illustrates a flow chart for a method for selectively contacting a cleaning composition with a surface of a turbine engine component, in accordance with some embodiments of the disclosure.

Referring now to FIG. 5, in some embodiments, the upper portion 211 further comprises a plurality of vent holes 203 in fluid communication with the cleaning chamber 213. As illustrated in FIG. 5, the manifold assembly 220 is in fluid communication with the plurality of vent holes 203 and a wash reservoir 260. The manifold assembly 220 is further configured to circulate a wash composition 20 to and from the cleaning chamber 213, via the plurality of vent holes 203 and the plurality of drain holes 202, as illustrated in FIG. 5. The wash composition 20 includes any suitable flushing fluid that may flush out any residual cleaning composition from one or both of the cleaning chamber 213 and the surface of the turbine engine component after the cleaning is effected. It should be noted that the number, shape, size, and location of the vent holes in FIG. 5 are for illustration purposes only. In some embodiments, the number of vent holes in the upper portion 211 may be in a range from about 4 to about 12. Further, the vent holes 203 and the drain holes 202 may be directly aligned with each other, or, alternatively, may be staggered with respect to each other. In some embodiments, the upper portion 211 may include an alternating arrangement of the fill holes 201 and the vent holes 203.

The manifold assembly 220 may be fluidly coupled to the vent holes 203 via one or more of pipes, conduits, and the like. In certain embodiments, the manifold assembly 220 is in fluid communication with the plurality of vent holes 203 via a plurality of pipes 219. FIG. 5 illustrates only two pipes 219, for ease of representation. However, the system 200 may include a plurality of pipes 219. In some embodiments, the system includes the same number of pipes 219 for circulating the wash composition 20 as the number of vent holes 203. In some embodiments, the system includes a fewer number of pipes 219 for circulating the wash composition 20, as compared to the number of vent holes 203.

The manifold assembly 220 may be in fluid communication with the wash reservoir 260 via an appropriate mechanism, for example, pipes, conduits, and the like. In the embodiment illustrated in FIG. 5, the manifold assembly is fluidly coupled to the wash reservoir via conduit 221. The inflow and outflow of the wash composition 20, to and from the manifold assembly 220, may be further controlled by using appropriate fluid control mechanisms, for example, valves.

In some embodiments, the vent holes may further facilitate one or both of: (1) avoiding or minimizing pressure build-up in the cleaning chamber as the cleaning chamber is filled with the cleaning composition; and (2) monitoring the level of the cleaning composition in the cleaning chamber by observing the cleaning composition reach the vent on top of the cleaning apparatus, which may indicate that the cleaning chamber is filled without any trapped air pockets and the entirety of the first portion is immersed in the cleaning composition.

In some embodiments, the system 200 further include a suitable pressurizing mechanism (for example, a pump) 270 for circulating the cleaning composition 10 to and from the cleaning chamber 213 via the manifold assembly, as illustrated in FIGS. 3 and 5.

A method for selectively contacting a cleaning composition with a surface of a turbine engine component is also presented, in some embodiments. The method includes disposing a first portion of the turbine engine component in a cleaning chamber of a cleaning apparatus, the cleaning chamber defined by an upper portion and a lower portion of the cleaning apparatus. The method further includes circulating the cleaning composition from a reservoir to the cleaning chamber via a manifold assembly and a plurality of fill holes disposed in the upper portion of the cleaning apparatus. The method further includes selectively contacting the cleaning composition with a surface of the first portion of the turbine engine component. The method furthermore includes recirculating the cleaning composition from the cleaning chamber to the reservoir via the manifold assembly and a plurality of drain holes disposed in the lower portion of the cleaning apparatus.

Referring now to FIGS. 3-6, a method 1000 for cleaning a gas turbine engine in accordance with one embodiment is illustrated. As shown in FIGS. 3-6, in some embodiments, at step 1001, the method includes disposing a first portion of the turbine engine component in a cleaning chamber 213 of a cleaning apparatus 210. As described in detail earlier, the first portion of the turbine engine component may include any portion that requires selective cleaning.

In some embodiments, the surface of the turbine engine component to be cleaned may be prepared prior to being contacted with the cleaning composition 10. For example, loosely adhered dirt and other debris may be mechanically removed by any means commonly used in the art, such as by directing a jet of air or liquid onto the surface, by scraping or brushing, or by any other convenient technique. In some embodiments, the method further includes a preparing step that includes applying a chemical preparation to the surface. The application of the chemical preparation may be additional to or an alternative to the mechanical removal of deposits. Various products are commercially available, such as those under the TURCO tradename, for removing oils and solid deposits from engine component. One example of such a chemical preparation is TURCO 4338 brand compound (commercially available from Henkel), an alkali metal permanganate formulation. Other non-limiting examples of commercially available chemical preparations include Ardrox 185L, Ardrox 1873, Ardrox 1218, and Ardrox 1435 (commercially available from BASF). Use of formulations of these types may assist in the overall cleaning process by partially reacting with oxides and other engine deposits to render them more readily reactive with the cleaning composition described herein applied during the contacting step. If a preparation step is applied, the surface may be subsequently rinsed to remove debris and/or the chemical preparation prior to contacting the surface with the cleaning composition. Further, the chemical preparation step may be applied prior to disposing the turbine engine component in the cleaning apparatus 210 (i.e., outside the cleaning apparatus), or, after disposing the turbine engine component in the cleaning apparatus 210 (i.e., inside the cleaning apparatus).

In some embodiments, the disposing step further includes disposing a second portion (e.g., hub portion 110) of the turbine engine component (e.g., turbine disk 100) in a masking chamber 214 defined by the upper portion 211 and the lower portion 212 of the cleaning apparatus 210, shown in FIGS. 4A and 4B. As described in detail earlier, the masking chamber 214 and the cleaning chamber 213 are fluidly sealed from each other via a sealing mechanism 230 (shown in FIGS. 4A and 4B) such that a surface of the second portion (e.g., hub portion 110) of the turbine engine component is not substantially contacted with the cleaning composition 10 during the circulating and contacting steps.

As noted previously, the design of the cleaning apparatus 210, as described herein, enables application of the cleaning composition 10 to selected portions of the turbine engine component, allowing locally targeted cleaning to occur. Thus, in one embodiment, the contacting step includes contacting the cleaning composition 10 with a portion of the turbine engine component, leaving another portion of the turbine engine component substantially free of contact with the cleaning composition. An example of such an embodiment includes an instance in which the turbine engine component is or includes a disk for a turbine engine assembly. In this illustrative example, the cleaning composition 10 may be applied to the dovetail portion (meaning application is to some or all of this portion) of the disk while leaving the remainder of the disk substantially free of contact with the composition. In the above example, the first portion of the turbine engine disposed in the cleaning chamber 213 may include dovetail regions 122 of a turbine disk 100. And, the remaining hub portion 110 is the second portion disposed in the masking chamber 214. In such example embodiments, the cleaning composition is selectively contacted with some or all of the dovetail regions 122 of the turbine disk 100 and the remaining hub portion 110 is substantially free of contact with the cleaning composition.

Similarly, dovetail portions (again, some or all of the dovetail portion) of turbine blades may be selectively contacted with the cleaning composition 10, leaving other regions of the blade free of contact with the composition. In yet another example, the rail portion of cases or frames may be selectively contacted with the cleaning composition 10, leaving other regions of these components free of contact with the composition. In the above examples, the first portion of the turbine engine disposed in the cleaning chamber 213 may include dovetail portions of the turbine blade, or rail portions of a turbine/compressor case. And, the remaining portions are the second portions disposed in the masking chamber 214.

Referring again to FIGS. 3-6, the method 1000, at step 1002, further includes circulating the cleaning composition from a reservoir 250 to the cleaning chamber 113 via a manifold assembly 220 and a plurality of fill holes 201 disposed in the upper portion 211 of the cleaning apparatus 210. The cleaning composition may be circulated using pipes or conduits (e.g., pipes 215) and suitable control mechanism (e.g., valves). The method further includes, at step 1003, selectively contacting the cleaning composition with a surface of the first portion of the turbine engine component.

The cleaning composition is selectively contacted with the surface of the turbine engine component for a time duration sufficient to allow at least partial removal of the oxide without undue damage to the underlying metal. In some embodiments, the cleaning composition is contacted with the surface of the turbine engine component for a time duration in a range from about 2 minutes to about 20 minutes. In certain embodiments, the cleaning composition is contacted with the surface of the turbine engine component for a time duration in a range from about 4 minutes to about 8 minutes. The contact time duration may be controlled by controlling the time duration for which the cleaning composition 10 is circulated through the cleaning chamber 113 of the cleaning apparatus 210. In some embodiments, the method includes controlling the time duration for circulating the cleaning composition through the cleaning chamber 213 via the manifold assembly 220, such that the desired amount of cleaning is effected. In some embodiments, the cleaning composition is circulated through the cleaning chamber 213 for a time duration in a range from about 2 minutes to about 20 minutes. In certain embodiments, the cleaning composition 10 is circulated through the cleaning chamber 213 for a time duration in a range from about 4 minutes to about 8 minutes.

Typically, the method is performed at atmospheric pressure, though this is not required. The method may be performed at any temperature. Selection of the temperature for any particular instance may depend in part on competing characteristics such as the desire for rapid reaction with/removal of the oxide, for which higher temperatures may be desirable; and the desire to avoid substantial reaction with the underlying metal of the article, for which a lower temperature may be desirable. In some embodiments, the contacting step is performed at ambient temperature (such as about 20 degrees Celsius) or above. In some embodiments, the contacting step is performed at a temperature below 60 degrees Celsius. In certain embodiments, the contacting step is performed at a temperature in a range from about 20 degrees Celsius to about 55 degrees Celsius; and in particular embodiments, the range is from about 20 degrees Celsius to about 45 degrees Celsius.

Referring again to FIGS. 3-6, the method 1000 furthermore includes, at step 1004, recirculating the cleaning composition 10 from the cleaning chamber 113 to the reservoir 250 via the manifold assembly 220 and a plurality of drain holes 202 disposed in the lower portion 212 of the cleaning apparatus 210. The cleaning composition may be recirculated using pipes or conduits (e.g., pipes 216) and suitable control mechanism (e.g., valves). The circulation and recirculation step of the method as described herein may allow for collection and reuse of the cleaning composition, which may not happen in an efficient manner in conventional cleaning methods (e.g., manual application or immersion). Further, the reuse of the cleaning composition may significantly reduce the volume of cleaning composition required when compared to standard immersion tanks employed for cleaning.

Furthermore, depending on the chemistry of the cleaning composition, in some embodiments it may be desirable to circulate the cleaning composition over the surface rather than allow the cleaning composition to stagnate. This may be particularly desirable for cleaning composition having strong reducing characteristics with respect to the base metal. In such instances, by not allowing the cleaning composition to stagnate on the surface of the turbine engine component, corrosion of the base metal (e.g., pit corrosion) may be avoided. In some embodiments, the cleaning fluid is circulated at a rate of about 0.1 liters/min to about 5 liters/min. In particular embodiments, the cleaning fluid is circulated at a rate of about 0.25 liters/min to about 2 liters/min.

The residual cleaning composition is then removed from one or both of the surface of the turbine engine component and the cleaning chamber. Along with the cleaning composition, other material such as loosened oxide, dirt, other engine deposits, and any reaction products that are formed due to reaction between the cleaning composition and the oxide may be removed as well. In some embodiments, the removing step may be effected by rinsing the contacted area with a solvent, such as water, by mechanically removing the composition, as by wiping, or via any other technique that effectively removes the cleaning composition from the surface. In embodiments involving mechanical removal of the cleaning composition, the turbine engine component may be removed from the cleaning apparatus and then subjected to the removal steps.

In certain embodiments, the cleaning composition is removed from the surface and the cleaning chamber by employing a solvent (for example, water) as a wash/flushing composition. In such instances, after the cleaning composition has been circulated through the cleaning chamber for the required time duration, the flow of the cleaning composition from the manifold assembly may be stopped by closing the appropriate valves. Further, the valves in the manifold assembly for the wash composition may be opened, thereby circulating a wash composition from a wash reservoir to the cleaning chamber. As illustrated in FIG. 5, the method further includes, circulating the wash composition 20 via a manifold assembly 220 and a plurality of vent holes 203 disposed in the upper portion 211 of the cleaning apparatus 210. Similar to the cleaning step, the method further includes recirculating the wash composition 20 from the cleaning chamber 213 to the wash reservoir 260 via the manifold assembly 220 and the plurality of drain holes 202 disposed in the lower portion 212 of the cleaning apparatus 210. Embodiments of the present disclosure may therefore advantageously collect the effluent stream using the wash composition. Therefore, facilitating collection of hazardous waste while minimizing human contact.

The wash composition is contacted with the surface of the turbine engine component for a time duration sufficient to allow at least partial removal of the cleaning composition from one or both of the surface of the turbine engine component and the cleaning chamber. In some embodiments, the wash composition is circulated through the cleaning chamber for a time duration in a range from about 2 minutes to about 20 minutes. In certain embodiments, the wash composition is circulated through the cleaning chamber for a time duration in a range from about 4 minutes to about 8 minutes. After removing the cleaning composition, the sequence of contacting and removing (with or without the preparation step) may be repeated, for example in cases where the amount of oxide removed from the surface is deemed insufficient.

In some embodiments, the cleaning composition is designed to have a viscosity that is sufficiently high to avoid undesirable amounts of flow of the composition during the cleaning process. Generally, the composition is formulated to have a viscosity of at least $10^4$ poise to achieve this purpose. The viscosity can be increased above this value if doing so enhances some aspect of the process. For instance, if the surface includes an incline such that gravity increases the risk of unwanted flow, a higher viscosity composition may be desirable. In some embodiments, the viscosity is less than or equal to $10^6$ poise; the upper bound on the viscosity may be dictated in part by the requirements of the system and process, by which the cleaning composition is applied to the surface. Viscosity values described herein typically refer to the value obtained at conditions of temperature and pressure that exist during the cleaning process.

The cleaning composition is formulated to remove the oxide from the surface of the turbine engine component, while avoiding undesirable levels of reaction with the metal of the turbine engine component. The minimum amount of oxide to be removed may be specified for a given process, based at least in part on the purpose of the cleaning procedure. For example, where visual inspection of the underlying metal is required, a certain minimum area fraction of oxide may be specified, below which the inspection of underlying metal is deemed ineffective. In the parlance of the art, the term "stock loss" is used to refer to the amount of underlying metal that is removed collaterally during the removal of the oxide. The amount of "stock loss" that can be tolerated in a given process is dictated at least in part by the nature of the component and the region being cleaned; for example, where the region being cleaned is expected to undergo high stress in service, relatively small stock loss may be tolerated to avoid undue weakening of the component. Moreover, in addition to or in place of defining a certain upper limit for stock loss, a given process may specify a certain quality of the surface after cleaning. For example, where a process may specify a thickness threshold, such as 25 micro inches (about 0.6 micrometers) for stock loss, it may further specify limits on the presence, number, and/or depth of corrosion pits that may be tolerated, the extent to which intergranular corrosion is allowed, and/or other boundary conditions.

Given the competing constraints of reactivity with the oxide and non-reactivity with the underlying metal, the cleaning composition is formulated to have selective reactivity with the oxide. As used herein, the term "selective reactivity" means that, for a given process, the composition shows acceptable reactivity with the oxide while complying with process specifications for stock loss and other attack of the metal. Those conversant in the art will appreciate that acceptable reactivity with the oxide and acceptable non-reactivity with the metal can be readily determined for a given combination of process conditions and metal compositions.

In some embodiments, the cleaning composition includes an acid, an active compound, and a thickening agent. The combination of a suitable acid along with the active compound provides the required selectivity to the cleaning composition with the oxide. In some embodiments, the acid includes a mineral acid, such as nitric acid, phosphoric acid, sulfuric acid, hydrochloric acid, acetic acid, or combinations thereof.

As used herein, the term "active compound" refers to a compound, such as a salt, that provides chemical moieties to the cleaning composition that participate in the removal of the oxide. In some embodiments, the compound includes a halide, such as a chloride. In certain embodiments, the active compound includes a ferric salt. In particular embodiments, the active compound includes ferric chloride, which has provided attractive performance to cleaning compositions applied to oxidized nickel-based superalloy components. The selection of a suitable active compound, and its concentration in the cleaning composition, will depend at least in part on the processing conditions and the nature of the metal and oxide.

The cleaning composition may further include water to form an aqueous solution. The combination of the acid, the active compound and remaining water may form an acid matrix. In some embodiments, the total amount of acid in the cleaning composition is in a range from about 150 g/L to about 850 g/L. In certain embodiments, the total amount of acid in the cleaning composition is in a range from about 200 g/L to about 800 g/L. In some embodiments, the total amount of active compound in the cleaning composition is in a range from about 10 g/L to about 200 g/L. In certain embodiments, the total amount of active compound in the cleaning composition is in a range from about 20 g/L to about 90 g/L. The balance amount may be made up of water (e.g., distilled water).

To achieve the desired levels of viscosity described previously, the cleaning composition further comprises a thickening agent. As used herein, the term "thickening agent" refers to an additive present in the cleaning composition that imparts a high viscosity relative to a composition lacking such an additive. In some embodiments, the thickening agent is dissolved in the acid matrix, creating a gel by promoting, for instance, a three-dimensional network of cross-linked material within the liquid matrix. In other embodiments, the thickening agent is granular material that becomes suspended within the acid matrix, forming a paste. The thickening agent is present in the cleaning composition in an amount effective to produce a desired level of viscosity; the viscosity of the cleaning composition described herein, as noted previously, is generally at least $10^4$ poise.

An inorganic compound that is substantially inert with respect to the acid matrix, such as, for instance, a plurality of oxide particles, provides one example of a thickening agent that may be suspended to form the cleaning composition. In some embodiments, the thickening agent includes a plurality of oxide particles including silica, titania, or combinations thereof. Examples of suitable oxide particles fumed silica, fumed titania, or combination thereof. The thickening behavior depends in part on the size and amount of particulate suspended within the matrix. Typically, though not necessarily, the nominal size (that is, the median size) of the particle components is in a range from about 0.005 micrometer to about 0.5 micrometer. In some embodiments, the nominal particle component size is in a range from about 0.005 micrometer to about 0.3 micrometer, and in particular embodiments, this range is from about 0.007 micrometer to about 0.2 micrometer. Regarding the amount of particulate present, as noted above the amount may be adjusted to provide the desired viscosity level for a given application. In some embodiments, the thickening agent is present in the cleaning composition at a concentration of at least about 0.5 percent by weight of the cleaning composition. In some embodiments, the concentration is up to about 5 percent by weight of the cleaning composition. In some embodiments, the thickening agent is present in the cleaning composition at a concentration in a range from about 1 weight percent to about 5 weight percent of the cleaning composition. In some embodiments, the thickening agent is present in the cleaning composition at a concentration in a range from about 1 weight percent to about 2 weight percent of the cleaning composition.

In certain embodiments, the cleaning composition includes hydrochloric acid, ferric chloride, and fumed silica. In some such instances, the cleaning composition includes about 10 g/L to about 20 g/L of fumed silica, 50 g/L to about 100 g/L of ferric chloride, 170 g/L to about 200 g/L of hydrochloric acid, and balance water. In certain embodiments, the cleaning composition includes nitric acid, sulfuric acid, hydrochloric acid, acetic acid, ferric chloride, and fumed silica. In some such instances, the cleaning composition includes about 10 g/L to about 20 g/L of fumed silica, 20 g/L to about 40 g/L of ferric chloride, 750 g/L to about 800 g/L of total acid, and balance water. In certain embodiments, a cleaning composition suitable for the methods and systems described herein is disclosed in co-pending U.S. patent application publication 2016/0024438, which disclosure is incorporated herein by reference.

As mentioned previously, conventional cleaning methods for cleaning turbine engine components (e.g., turbine disks prior to crack inspection) may require multiple rounds of cleaning steps, before the surface is effectively cleaned. For example, some conventional cleaning methods may involve application of a 4-step cleaning cycle involving an alkaline composition, a first acid composition; an alkali metal permanganate composition; and a second acid composition. Because of the presence of tenacious oxides on the surface, the steps involving alkali metal permanganate solution and the second acid composition may need to be repeated multiple times (e.g., at least 20 times), before cleaning may be effected. This may result in time-consuming and cost-ineffective cleaning cycles.

Further, conventional cleaning methods may employ liquid cleaning compositions, which may not be desirable in situations where the area over which the cleaning composition is contacted with, need to be limited. For instance, some components include multiple materials, where one or more of the materials is incompatible with the cleaning composition. As another example, in some components there is a propensity to develop deposits only in specific locations, while other locations on the component remain acceptably free of deposits. In instances, such as these, where only selective exposure of the component area to the cleaning composition is desirable, conventional cleaning methods using liquid cleaning compositions may necessitate additional steps, such as component disassembly, masking procedures, or having to reapply dimensional build up materials and other techniques that add time and expense to the overall cleaning process.

Some embodiments of the present disclosure further address the noted shortcomings in conventional cleaning methods by employing cleaning composition of high viscosity relative to conventional liquid cleaning compositions. The viscous composition substantially remains in the region of the part on which it is disposed during the cleaning procedure, thereby providing the ability to clean selected areas of a turbine engine component without unduly exposing adjacent areas where exposure to a cleaning composition is undesirable or incompatible with component materials.

Figure 7:
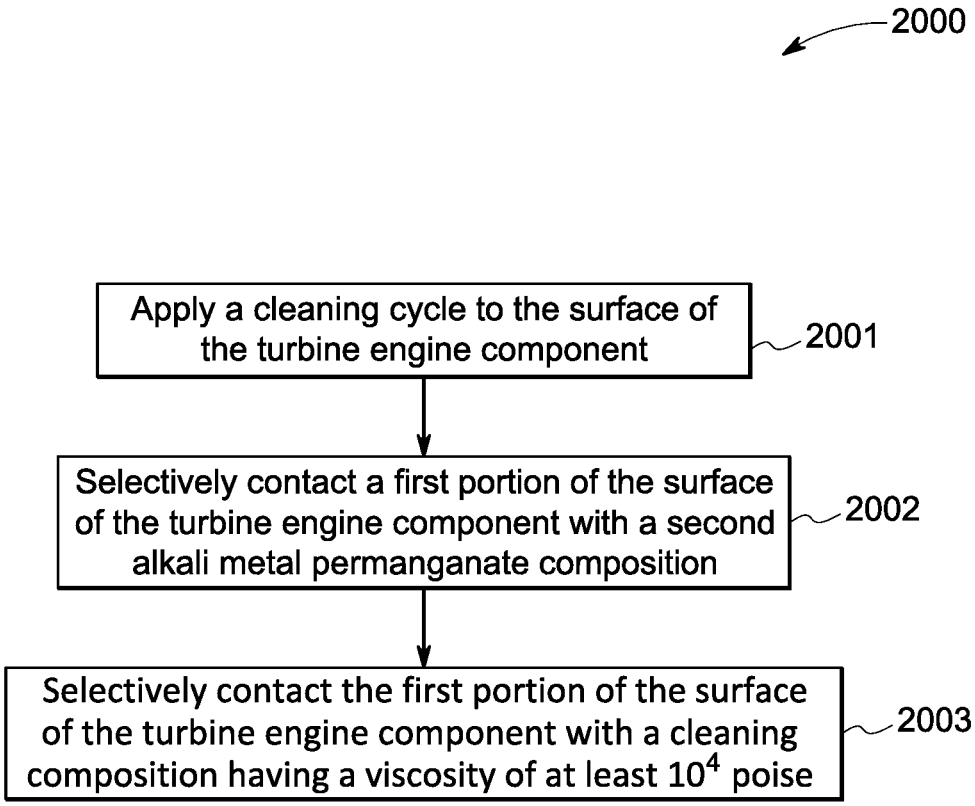
FIG. 7 illustrates a flow chart for a method for selectively contacting a cleaning composition with a surface of a turbine engine component, in accordance with some embodiments of the disclosure.

In some embodiments, a method for selectively cleaning a surface of a turbine engine component using a viscous cleaning composition is presented. The method is described with reference to FIG. 7. As shown in FIG. 7, the method 2000 includes, at step 2001, applying a cleaning cycle to the surface of the turbine engine component. The step 2001 of applying a cleaning cycle includes the steps of sequentially contacting the surface of the turbine engine component with an alkaline composition, a first acid composition, a first alkali metal permanganate composition, and a second acid composition. In some embodiments, the step 2001 of applying a cleaning cycle is similar to a 4-step conventional cleaning cycle applied for cleaning turbine engine component prior to inspection. Non-limiting examples, of an alkaline composition include Ardrox 185L, of a first acid composition include Ardrox 1873, of a first alkali metal permanganate composition include Ardrox 1435, and of the second acid composition includes Ardrox 1218. As noted previously, Ardrox is a brand name of compositions available from BASF. In some embodiments, the method 2000 may further include one or more preparatory steps before step 2001, for preparing the surface of the turbine engine component, described in detail earlier.

The cleaning cycle may be applied to the entire surface of the turbine engine component or only a portion of it. In some embodiments, the cleaning cycle may be applied to the entire surface of the turbine engine component. For example, when the turbine engine component is a turbine disk 100 (shown in FIG. 1), the step 2001 of applying a cleaning cycle may be effected on both the portions 110 and 120 of the disk. Application of the 4-step cleaning cycle may allow for restoration of the parent metal on the surface of the turbine engine component. However, as mentioned earlier, certain portion of the turbine engine component may include complex oxides of one or more metals. The cleaning cycle may not be effective enough to efficiently remove these oxides from the surface without the use of abrasive cleaning methods or a large number of cleaning cycle repetitions.

Therefore, the method further includes, at step 2002, selectively contacting a first portion of the surface of the turbine engine component with a second alkali metal permanganate composition. The second alkali permanganate solution may be the same as the first alkali permanganate composition employed in step 2001, in some embodiments. The second alkali permanganate solution may be different from the first alkali permanganate composition employed in step 2001, in some embodiments. The second alkali permanganate solution may further oxidize the surface of the first portion of the turbine engine component.

The method 2000 furthermore includes, at step 2003, selectively contacting the first portion of the surface of the turbine engine component with a cleaning composition having a viscosity of at least $10^4$ poise. As noted herein earlier, by employing a viscous cleaning composition, selective cleaning of the turbine engine component may be efficiently and effectively implemented. The steps (II) and (III) are effected such the remaining second portion of the surface of the turbine engine component is substantially free of contact with the alkali metal permanganate composition and the cleaning composition.

The steps 2002/2003 of selectively contacting the surface of the turbine engine component may be accomplished using any technique used in the art for applying compositions to surfaces. Examples of such techniques include brushing, swabbing, or extruding the composition onto the surface. As noted previously, the viscous nature of the cleaning composition enables application of the composition to selected portions of the article, allowing locally targeted cleaning to occur. In particular embodiments, the steps (II) and (III) may be implemented using the systems and methods described herein earlier with reference to FIGS. 1-6.

The cleaning composition provides for at least partial removal of the oxides from the selected surfaces of the turbine engine component. In certain embodiments, the cleaning composition includes a third acid composition, an active compound, and a thickening agent. Non-limiting examples suitable acids in the third acid composition include mineral acids, such as nitric acid, phosphoric acid, sulfuric acid, hydrochloric acid, acetic acid, or combinations thereof. Non-limiting example of a suitable active compound include ferric chloride. Non-limiting examples of suitable thickening agent include fumed silica, fumed titania, or a combination thereof. The compositional characteristics of the cleaning composition are described in detail earlier.

The cleaning composition is selectively contacted with the surface of the turbine engine component for a time duration sufficient to allow at least partial removal of the oxide without undue damage to the underlying metal. In some embodiments, the cleaning composition is contacted with the surface of the turbine engine component for a time duration in a range from about 2 minutes to about 20 minutes. In certain embodiments, the cleaning composition is contacted with the surface of the turbine engine component for a time duration in a range from about 4 minutes to about 8 minutes.

The residual cleaning composition is then removed from the surface of the turbine engine component, using one or more of the aforementioned techniques describe in detail earlier. After removing the cleaning composition, the sequence of applying, contacting and removing (with or without the preparation step) may be repeated, for example in cases where the amount of oxide removed from the surface is deemed insufficient. In some embodiments, after step 2003, the sequence of steps 2001, 2002 and 2003 may be repeated n times, wherein n is 1 to 3. In particular embodiments, the methods and techniques described herein are effective in removing a sufficient amount of oxide without requiring the repetition of steps 2001, 2002 and 2003.

In some embodiments, the method may further include the step (not shown in Figures) of inspecting the surface of the turbine engine component for cracks. Any suitable technique for crack inspection may be employed. In certain embodiments, the methods and techniques described herein may be particularly suitable for cleaning surfaces of turbine engine components before crack inspection using fluorescence penetrant inspection (FPI).

EXAMPLES

The following examples are presented to further illustrate non-limiting embodiments of the present disclosure.

A turbine disk that had been previously exposed to elevated temperature exhibited oxide formation in its dovetail portion. The disk included a nickel-based superalloy. The disk was subjected to a single standard, 4-step cleaning cycle to restore the parent metal of the disk for detailed visual inspection. The 4-step cleaning cycle included sequential application of Ardrox 185L, Ardrox 1873, Ardrox 1218, and Ardrox 1435 (commercially available from BASF). The disk was further subjected to rinsing steps in between. After the application of a 4-step cleaning cycle, the dovetail portions of the turbine disk were contacted with an alkali meta; permanganate solution (Ardrox 188) using a conventional immersion tank, to oxidize the dovetail surface, per manufacturer's guidelines for 30-60 minutes.

After the step of applying the alkali metal permanganate solution, the turbine disk was rinsed and then disposed in a clam shell cleaning apparatus (e.g., a cleaning apparatus illustrated in FIGS. 3-5). A viscous cleaning composition in accordance with the embodiments described herein was applied to the oxide deposits on the dovetail region using the systems and methods described herein. The viscous cleaning composition included about 180-200 g/L of hydrochloric acid, about 50-100 g/L of ferric chloride, about 18.75-21 g/L of fumed silica (nominal size 0.2 micrometers), and balance water. The cleaning composition was circulated through the cleaning chamber using a manifold system at speed of about 1 liter/min for 6 minutes. The cleaning composition was recirculated and reused, thereby limiting the total cleaning composition volume to less than 2 liters relative to standard immersion tanks requiring 6,000-liter volume. All the dovetail posts in the disk were subjected to the contacting and cleaning steps simultaneously, thereby reducing the cleaning time to less than 1 production shift, as compared to a week for standard immersion cleaning techniques. The cleaning composition was removed from the blade after 6 minutes of circulating the cleaning composition, by flushing the cleaning chamber with water. The disk was then inspected for cleaning effectiveness, and readiness for FPI inspection. A substantial portion of the oxide deposits was observed to have been removed from the disk dovetail posts, and the disk was able to be FPI inspected. Damage to the underlying metal of the blade was minimal.

The appended claims are intended to claim the invention as broadly as it has been conceived and the examples herein presented are illustrative of selected embodiments from a manifold of all possible embodiments. Accordingly, it is the Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied; those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

The invention claimed is:

1. A system for selectively removing a deposit from a surface of a turbine engine component, comprising:

a cleaning apparatus, comprising:

an upper portion;

a lower portion coupled to the upper portion about a first portion of the turbine engine component so as to form a cleaning chamber having the first portion disposed therein, the cleaning chamber configured to allow selective contact between a cleaning composition and a surface of the first portion of the turbine engine component requiring cleaning, and a sealing mechanism sealing the cleaning chamber about the first portion such that the cleaning composition does not come into contact with a second portion of the turbine engine component arranged relative to the upper and lower portions, wherein the upper portion comprises a plurality of fill holes in fluid communication with the cleaning chamber, and the lower portion comprises a plurality of drain holes in fluid communication with the cleaning chamber; and a manifold assembly in fluid communication with the plurality of fill holes and the plurality of drain holes, the manifold assembly configured to selectively circulate the cleaning composition from a reservoir to the cleaning chamber via the plurality of fill holes, recirculate the cleaning composition from the cleaning chamber to the reservoir via the plurality of drain holes, and recirculate the cleaning composition through the cleaning chamber until the desired amount of cleaning is effected.

2. The system of claim 1, wherein the upper portion and the lower portion further define a masking chamber for receiving the second portion of the turbine engine component.

3. The system of claim 2, wherein the masking chamber and the cleaning chamber are fluidly sealed from each other via the sealing mechanism.

4. The system of claim 1, further comprising:

a wash composition configured to be circulated through the cleaning chamber after the desired amount of cleaning is effected.

5. The system of claim 1, wherein the manifold assembly is in fluid communication with the reservoir comprising the cleaning composition.

6. The system of claim 1, wherein the turbine engine component comprises a turbine disk, a turbine blade, a compressor disk, a compressor blade, a compressor spool, a rotating seal, a frame, or a case.

7. The system of claim 1, wherein the first portion of the turbine engine component comprises a dovetail portion of a turbine disk.

8. The system of claim 1, wherein an Oscar composition is configured to flush a residual portion of the cleaning composition from the cleaning chamber and the surface of the turbine engine component.

9. The system of claim 1, wherein the cleaning composition has a viscosity of at least $10^4$ poise.

10. The system of claim 1, wherein the second portion of the turbine engine component comprises a hub portion of the turbine disk.

11. The system of claim 1, wherein the cleaning composition comprises hydrochloric acid, ferric chloride, and fumed silica.

12. The system of claim 1, wherein the cleaning composition comprises nitric acid, sulfuric acid, hydrochloric acid, acetic acid, ferric chloride, and fumed silica.

13. The system of claim 1, wherein the cleaning composition comprises a third acid composition, an active compound, and a thickening agent.

14. The system of claim 13, wherein the third acid composition comprises nitric acid, phosphoric acid, sulfuric acid, hydrochloric acid, acetic acid, or combinations thereof.

15. The system of claim 13, wherein the active compound comprises a ferric salt.

16. The system of claim 13, where the thickening agent comprises a plurality of particle components comprising silica, titania, or combinations thereof.

* * * * *